US005419388A

United States Patent [19]

Hickel et al.

[11] Patent Number: 5,419,388

[45] Date of Patent: May 30, 1995

[54] REGENERATIVE HEAT EXCHANGER SYSTEM AND AN OPERATING METHOD FOR THE SAME

[75] Inventors: Steven D. Hickel, New Hope; Lynn C. Marksberry, Plymouth, both of Minn.; Toshikazu Yamamura, Kakogawa, Japan; Shuuhei Natani, Akashi, Japan; Toshio Kurosaka, Takarazuka, Japan

[73] Assignee: Fluidyne Engineering Corporation, Minneapolis, Minn.

[21] Appl. No.: 251,715

[22] Filed: May 31, 1994

[51] Int. Cl.[6] ..... F23L 15/02

[52] U.S. Cl. ..... 165/9.3; 165/18; 432/39

[58] Field of Search ..... 165/9.1, 9.3, 9.4, 10, 165/18; 432/181, 180, 179, 215, 39

[56] References Cited

U.S. PATENT DOCUMENTS 4,088,180 5/1978 Tsai ..... 165/9.3 X
4,256,173 3/1981 Tsai et al. ..... 165/9.3
4,291,750 9/1981 Clyne et al. ..... 165/10 X
4,346,753 8/1982 Kletch ..... 165/9.4 X
4,394,122 7/1983 Bueno et al. ..... 432/181 X
4,974,666 12/1990 Hirata et al. ..... 165/9.4 X
5,052,918 10/1991 Fassbinder ..... 165/9.3 X

*Primary Examiner*—John Rivell
*Assistant Examiner*—Christopher Atkinson
*Attorney, Agent, or Firm*—Palmatier, Sjoquist & Helget

[57] ABSTRACT

A regenerative heat exchanger system includes a heat accumulator provided in an insulating vessel for accumulating heat energy, the heat accumulator having a first end and a second end opposing to the first end and being capable of permitting gas to flow through a body between the first and second ends, a heating device for heating the heat accumulator in such a manner that the heat accumulator is formed with a plurality of temperature-different regions, a medium gas-supplying device for flowing medium gas through the plurality of temperature-different regions independently from one another.

12 Claims, 10 Drawing Sheets

REGENERATIVE HEAT EXCHANGER SYSTEM AND AN OPERATING METHOD FOR THE SAME

BACKGROUND OF THE INVENTION

1. Field of the Invention

The present invention relates to a regenerative heat exchanger system and an operating method for such regenerative heat exchanger system.

2. Description of the Prior Art

A regenerative heat exchanger system is generally advantageous in transferring heat energy from a heating gas having an extremely high temperature to a separate gas to be heated (hereinafter referred to as "medium gas").

FIG. 10 shows a conventional regenerative heat exchanger system. In the drawing, an insulating vessel 90 has a top portion equipped with a burner 92 for supplying high temperature heating gas. The insulating vessel 90 has an upper part defining an inside space 94 therein and a lower part accommodating a heat accumulator 96 made of bricks or the like. The insulating vessel 90 has a bottom portion provided with a passage 98 for permitting medium gas to flow in as well as permitting the heating gas to flow out. This passage 98 has an inlet 99 at a lower end thereof. Although not shown in the drawing, a source for medium gas is connected to the inlet 99 of the passage 98 through a valve 100. Furthermore, an outlet 102 is formed in a side wall of the insulating vessel 90 at a position adjacent to the inside space 94 for flowing the gas to be out of the vessel 90. This outlet 102 is connected to downstream equipment (not shown) through a valve 104.

This type of regenerative heat exchanger system is operated in the following manner.

(1) First of all, the burner 92 generates high temperature heating gas, which is then supplied downward through the space 94 to the heat accumulator 96. The heating gas flows downward through the heat accumulator 96 and goes out of the insulating vessel 90 after passing through the passage 98. A supply of high temperature heating gas from the burner 92 to the heat accumulator 96 continues for a predetermined time to heat up the heat accumulator 96 sufficiently.

(2) Next, a medium gas, such as argon gas, is supplied upward from the bottom of the heat accumulator 96 to pass through the heat accumulator 96, thereby transferring heat energy stored in the heat accumulator to the medium gas. The medium gas, having passed through the heat accumulator 96 and having been heated up to a high temperature, is flowed to downstream components through the outlet 102.

A typical disadvantage of this type of regenerative heat exchanger system is that the heat exchange between the heating gas and the medium gas causes reduction of temperature in the heat accumulator 96 with elapsing time. Accordingly, if a significant amount of time has passed, the medium gas will not have a sufficiently high temperature at the outlet 102. Consequently, it is normally difficult to stabilize or maintain the medium gas at a necessary temperature at the outlet 102 for a long time.

To solve this disadvantage, for example, there have been conventionally proposed the following two systems (A) and (B).

(A) Two regenerative heat exchangers, termed the first and second, are provided. In the beginning of operation, the first regenerative heat exchanger alone is put in operation because the satisfactory temperature is assured for the medium gas. However, the temperature of the medium gas flowing out of the first regenerative heat exchanger gradually decreases as time passes. When a predetermined time has passed, the second regenerative heat exchanger is put in operation to compensate for the temperature reduction of the first regenerative heat exchanger. In other words, the respective operation timing of the first and second regenerative heat exchanger are shifted relative to each other for stabilization of the medium gas temperature. The temperature of the medium gas is stabilized by mixing high and low temperature gas between the first and second regenerative heat exchanger. This method is, for example, disclosed in Japanese Patent Publication No. 61-285394.

(B) In the regenerative heat exchanger system of FIG. 10 a bypass passage connecting the inlet 99 and the outlet 102 directly is provided to allow a part of the medium gas to bypass the heat accumulator 96. The bypass gas is thereafter mixed at the outlet 102 with the non-bypass medium gas passing through the heat accumulator 96. Control of the bypass gas is performed in such a way that the flow of the bypass is reduced with elapsing time, thereby stabilizing the gas temperature flowing out of the valve 104.

However, the above two systems are disadvantageous in the following points. In accordance with the system (A), at least two regenerative heat exchangers must be provided. This will inevitably increase the overall size of the equipment. On the other hand, in accordance with the system (B), a part of the medium gas is made to bypass the heat accumulator 96 and not receive the heat energy of the high temperature heating gas. This will result in a lower thermal efficiency since the regenerative heat exchanger system is not fully utilized. Furthermore, since the bypass gas is not heated at all, its temperature remains at an extremely low temperature. If such cool bypass gas having a low temperature is mixed with the heated gas at a high temperature, the resultant temperature will vary widely even if the added bypass gas amount is small. Accordingly, it is difficult to control the temperature accurately.

SUMMARY OF THE INVENTION

It is an object of the present invention to provide a regenerative heat exchanger system and an operating method for a heat exchanger system operating method which have overcome the above-mentioned problems residing in the prior art.

It is another object of the present invention to provide a regenerative heat exchanger system and an operating method for a heat exchanger system which can stabilize the temperature of the medium gas for a longer time without increasing the number of regenerative heat exchanger systems.

Accordingly, a first aspect of the present invention is directed to a regenerative heat exchanger system comprising a vessel formed by an insulating wall; a heat accumulator provided in the insulating vessel for accumulating heat energy, the heat accumulator having a first end and a second end opposing the first end and being capable of permitting gas to flow through a body between the first and second ends; heating means for heating the heat accumulator by flowing a heating gas from the first end to the second end in such a manner that the heat accumulator is defined with a plurality of different temperature regions in a direction normal of the gas flowing direction; medium gas-supplying means for flowing medium gas through the plurality of different temperature regions independently from one another from the second end to the first end after the heat accumulator has been heated; mixing means provided adjacent to the first end for mixing heated medium gas having passed one temperature region with heated medium gas having passed another temperature region.

The heat accumulator may be provided with a high temperature region and a low temperature region. Also, it may be appropriate that the high temperature region is defined on an inner portion of the heat accumulator while the low temperature region is defined on an outer portion of the heat accumulator.

It may be preferable that the high temperature region and the low temperature region are made of a plurality of blocks being piled in the gas flowing direction, each block having a gas passage extending in the gas flowing direction. Also, one layer of the piled blocks of the high temperature region may be made of blocks separated from one another in either a circumferential direction or a radial direction. Further, one layer of the piled blocks of the low temperature region may be made of blocks separated from one another in either a circumferential direction or a radial direction. Furthermore, it may be preferable that the block layers of the high temperature region and the block layers of the low temperature region are shifted from each other in the gas flowing direction.

It may be preferable that one of the high temperature regions and the low temperature regions is made of a plurality of blocks being piled in the gas flowing direction, each block having a gas passage extending in the gas flowing direction, and the other temperature region is made of a number of small solids having shapes different from one another.

Furthermore, it may be preferable that the medium gas-supplying means is constructed by flow-adjusting means for adjusting the flow of medium gas to the high temperature region and the low temperature region; and control means for controlling the flow-adjusting means to increase the flow of medium gas to the high temperature region with elapsing time after initiating the supplying of the medium gas to the heat accumulator.

Furthermore, it may be preferable that the medium gas-supplying means is construed by temperature detecting means for detecting a temperature of heated medium gas mixed by the mixing means; flow-adjusting means for adjusting the flow of medium gas to the high temperature region and the low temperature region; and control means responsive to the temperature detecting means for controlling the flow-adjusting means to adjust the respective flows of medium gas to the high and low temperature regions to keep the heated medium gas at a predetermined temperature.

Also, the present invention is directed to a method for operating a regenerative heat exchanger system including a heat accumulator capable of providing a plurality of temperature different regions, the method comprising the steps of flowing medium gas through the plurality of temperature different regions independently from one another; and increasing the flow of medium gas to a higher temperature region of the plurality of temperature different regions with elapsing time after initiating the supplying of the medium gas to the heat accumulator.

Also, the present invention is directed to a method for operating a regenerative heat exchanger system including a heat accumulator capable of providing a plurality of temperature-different regions, the method comprising the steps of flowing medium gas through the plurality of temperature-different regions independent from one another; detecting a temperature of a mixture of heated medium gases from the plurality of temperature-different regions of the heat accumulator; and controlling the flow of medium gas to the plurality of temperature different regions to keep the mixture at a predetermined temperature.

With thus constructed regenerative heat exchanger system, the plurality of temperature-different regions are defined in the heat accumulator in the direction normal to the gas flowing direction on the basis of temperature distribution which is caused after being heated by the heating gas. Medium gas is flowed to the plurality of temperature-different regions independently from one another and the flow of medium gas to a higher temperature region is increased with elapsing time after initiating the supplying of the medium gas to the heat accumulator. Also, a temperature of a mixture of heated medium gases from the plurality of temperature-different regions is detected and the flow of medium gas to the plurality of temperature-different regions is controlled so as to keep the mixture at a predetermined temperature. Accordingly, the temperature of heated medium gas can be stabilized or maintained at a desired high temperature for longer time.

Also, a high temperature region is defined on an inner portion while a low temperature region is defined on an outer portion near to the wall of the vessel. Accordingly, the heat energy on the outer portion can be efficiently utilized before the outer portion is cooled by the air outside of the vessel.

Further, the heat accumulator is made of a plurality of piled blocks each having gas passages in the gas flowing direction. Accordingly, heat exchange is effectively performed between the heat accumulator and the medium gas. Also, one layer of the heat accumulator is made of blocks separated from one another in a radial or circumferential direction. Accordingly, a clearance between blocks can offset the thermal expansion of the heat accumulator, and the thermal strength and thermal durability are considerably improved.

Further, the block layers of the high temperature region and those of the low temperature region are shifted from one another in the gas flowing direction. This can prevent thermal energy from flowing from the higher temperature region to the lower temperature region. Consequently, the insulation between the temperature-different regions can be remarkably improved.

Furthermore, either the high temperature region or the low temperature region is made of a number of small solids having different shapes. Accordingly, spaces between small solids can enhance the heat exchange between the heat accumulator and the medium gas.

The above and other objects, features and advantages of the present invention will become more apparent from the following detailed description which is to be read in conjunction with the accompanying drawings.

DETAILED DESCRIPTION OF THE PREFERRED EMBODIMENTS

Figure 1:
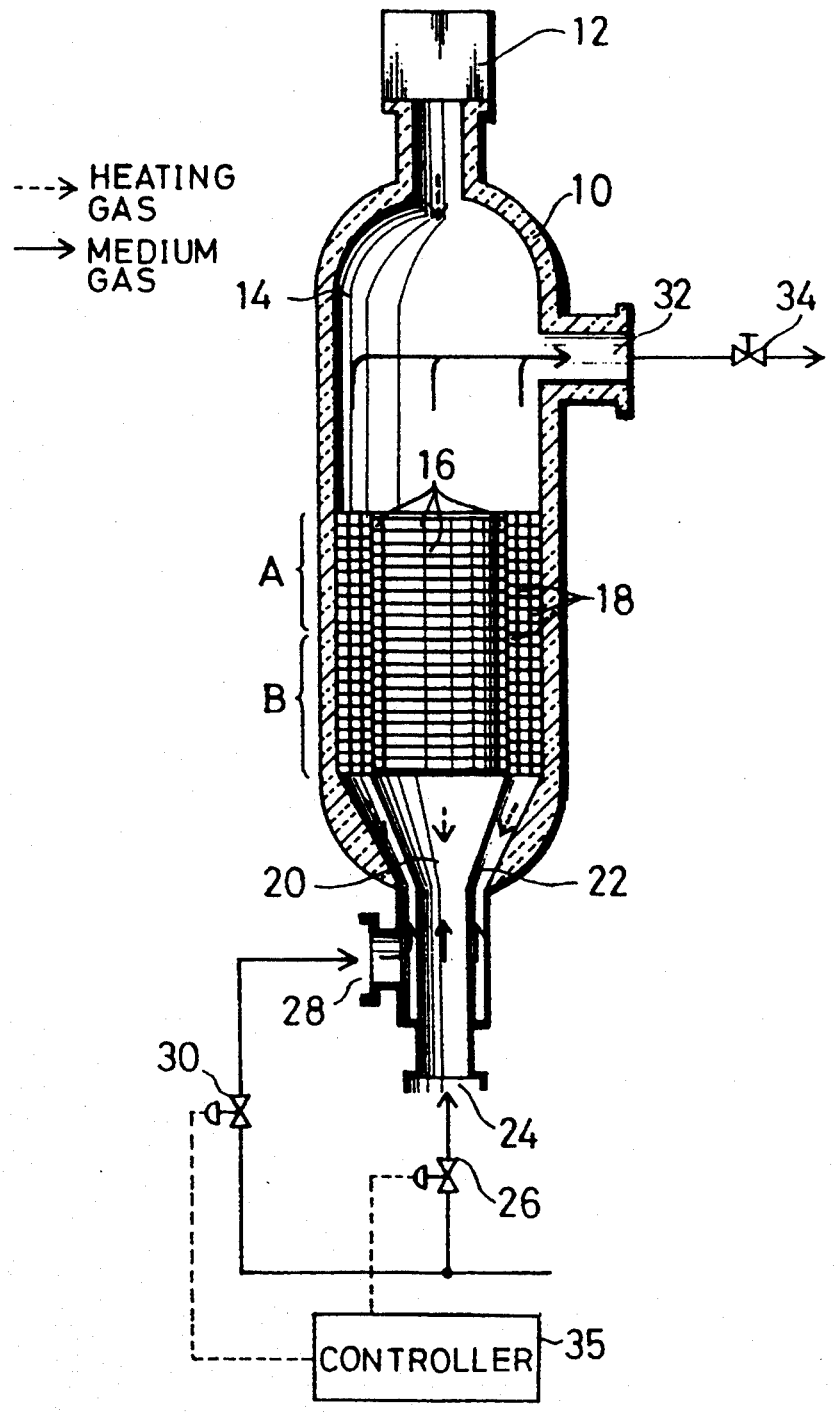
FIG. 1 is a schematic diagram showing a first regenerative heat exchanger system in accordance with the present invention.

Hereinafter, preferred embodiments of the present invention will be described in detail with reference to the accompanying drawings.

A first embodiment of the present invention will be described with reference to FIGS. 1–4. A regenerative heat exchanger system shown in FIG. 1 comprises an insulating vessel 10 extending in a vertical direction. The insulating vessel 10 has a top portion equipped with a burner 12 for supplying high temperature heating gas. The insulating vessel 10 has an upper part defining a mixing chamber 14 therein and a lower part accommodating a center heat accumulator 16 and a periphery heat accumulator 18. The center and periphery heat accumulators 16 and 18 are made of bricks which are piled up in the vertical direction of the insulating vessel 10 and through which heating and medium gases are flowed. In more detail, the center and periphery heat accumulators 16 and 18 have gas passages **16*a* and 18*a* extending through bricks in the vertical direction of the insulating vessel 10**.

Figure 2:
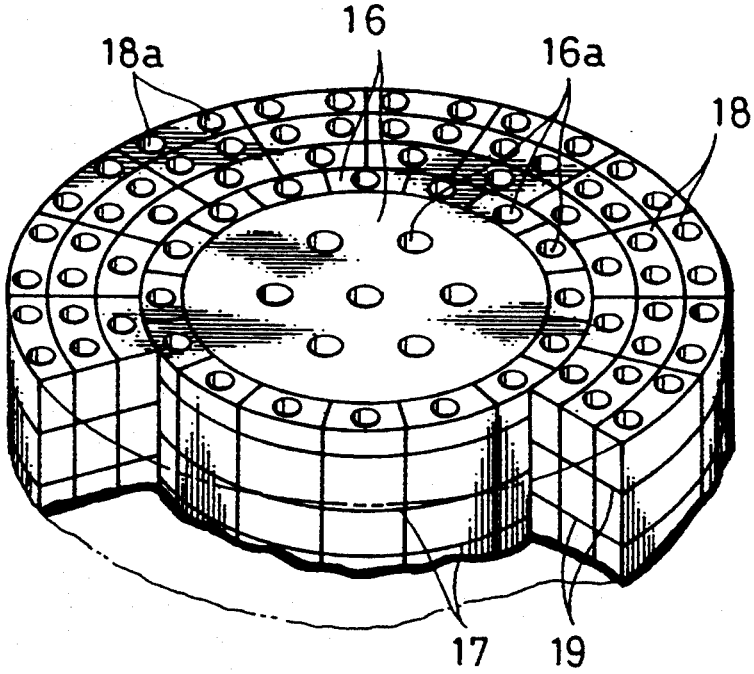
FIG. 2 is a perspective view showing a heat accumulator made of bricks piled up in the regenerative heat exchanger system.

As shown in FIG. 2, the center heat accumulator 16 has a core portion and a boundary portion which are defined concentrically. The boundary portion is made of a number of blocks separated from one another in a circumferential direction thereof. The periphery heat accumulator 18 has a ring-like configuration and is disposed around the center heat accumulator 16. More specifically, the periphery heat accumulator 18 extends in a direction normal to the gas flowing direction. The periphery heat accumulator 18 is made of a number of blocks. In the drawing, blocks of the periphery heat accumulator 18 are arrayed in both radial and circumferential directions.

Although the bricks of the center and periphery heat accumulators 16 and 18 are piled up in the vertical direction with boundaries 17 and 19 respectively, there boundaries 17 and 19 are shifted from each other.

The material for the heat accumulators 16 and 18 will not be limited to the same composition. However, in the regenerative heat exchanger system used in the MHD generating facility shown in this embodiment, an upper portion A of the heat accumulators 16, 18 is raised to extremely high temperatures. Therefore, it will be preferable to use zirconia bricks for the upper portion A. On the other hand, for a lower portion B aluminum bricks would be used.

The insulating vessel 10 has a bottom portion provided with first and second passages 20 and 22. The first passage 20 has a circular cross section and is connected to the bottom of the center heat accumulator 16 to exclusively introduce the medium gas to the center heat accumulator 16. The second passage 22 has a ring-shaped cross section and is connected to the bottom of the periphery heat accumulator 18 to exclusively introduce the medium gas to the periphery heat accumulator 18. In other words, the first and second passages 20 and 22 are independent from each other. The second passages 22 surround the first passage 20. The first passage 20 has an inlet 24 at a lower end thereof. Although not shown in the drawing, a source for medium gas is connected to the inlet 24 of the first passage 20 through a flow-adjusting valve 26 serving as flow-adjusting means. On the other hand, the second passage 22 has an inlet 28 at a lower end thereof. The source for medium gas is connected to the inlet 28 of the second passage 22 through a flow-adjusting valve 30 serving as flow-adjusting means.

Further, an outlet 32 is formed in a side wall of the insulating vessel 10 at a position adjacent to the mixing chamber 14 for flowing the medium gas out of the vessel 10. The outlet 32 is connected to downstream equipment through a valve 34.

This regenerative heat exchanger system further comprises a controller 35 serving as flow control means. The controller 35 is associated with the flow-adjusting valves 26 and 30 and generates control signals to these flow-adjusting valves 26 and 30 to adjust the gas flow passing through the first and second passages 20 and 22 independently.

Next, a control operation of the regenerative heat exchanger system will be described. First of all, the valves 26, 30 and 34 are all closed. The burner 12 produces high temperature heating gas which is then supplied downward to the center and periphery heat accumulators 16 and 18. The heating gas, after passing through the center and periphery heat accumulators 16 and 18, flows downward and goes out of the insulating vessel 10 through an outlet (not shown). During the heating, gas flows through the gas passages **16*a* and 18*a* of the center and periphery heat accumulators 16 and 18 and heat energy of the heating gas is transferred to the center and periphery heat accumulators 16 and 18. Since the periphery heat accumulator 18 is cooled down a little bit by the external air via the side wall of the insulating vessel 10, temperature of the periphery heat accumulator 18 is generally lower than that of the center heat accumulator 16**.

After such heating operation, the valve 34 is opened. Further, the flow-adjusting valves 26 and 30 are opened by the controller 35. The medium gas is, thereafter, supplied upward to the center and periphery heat accumulators 16 and 18 independently through the first and second passages 20 and 22, respectively. The medium gas, after having passed through the center and periphery heat accumulators 16 and 18, is mixed in the mixing chamber 14 and then flowed out of the outlet 32.

Figure 4:
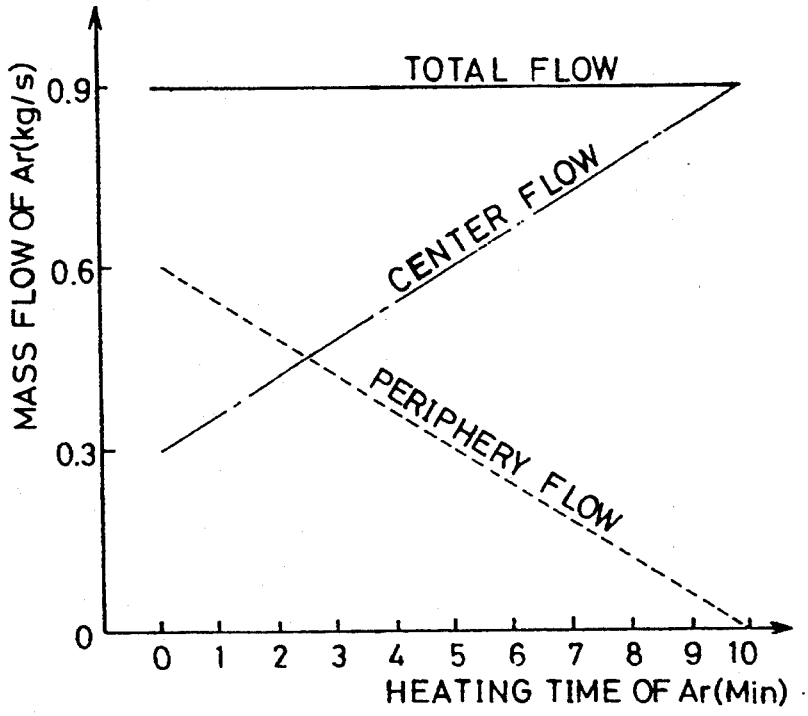
FIG. 4 is a graph showing flow control executed for the regenerative heat exchanger system.

In this case, the controller 35 controls the flow-adjusting valves 26 and 30 in a manner shown by a graph of FIG. 4. Specifically, a total flow of the medium gas is maintained at substantially a constant value. However, the medium gas supplied to the center heat accumulator 16 (i.e. higher temperature region) is gradually increased as time elapses. On the other hand, the medium gas supplied to the periphery heat accumulator 18 (i.e., lower temperature region) is gradually decreased as time elapses. In accordance with the example shown by the graph of FIG. 4, approximately 60% of the medium gas is supplied to the periphery heat accumulator 18 and the remaining 40% of the medium gas is supplied to the center heat accumulator 16 at the beginning of the heat exchange operation (i.e., at 0 min.). Then, the medium gas supplied to the periphery heat accumulator 18 is gradually reduced. After ten minutes has passed, supplying of the medium gas to the periphery heat accumulator 18 is substantially stopped and almost all the medium gas is supplied to the center heat accumulator 16.

In accordance with this control, a greater amount of medium gas is supplied to the periphery heat accumulator 18 in the beginning of supplying of the medium gas, because the periphery heat accumulator 18 still has sufficiently higher temperature. The flow of the medium gas passing through the periphery heat accumulator 18 is gradually decreased as time elapses because the temperature of the periphery heat accumulator 18 decreases due to heat exchange. Meanwhile, the center heat accumulator 16 still keeps high temperature. Therefore, the flow of the heated gas passing through the center heat accumulator 16 is gradually increased to compensate for the temperature reduction in the periphery heat accumulator 18. Consequently, it will be possible to stabilize the medium gas temperature at a relatively higher temperature zone for a longer time.

In particular, in accordance with this embodiment, the boundaries 17, - - - ,17 of the center heat accumulator 16 and the boundaries 19, - - - ,19 of the periphery heat accumulator 18 are shifted relative to each other in the vertical direction. This shifting arrangement is advantageous in preventing the medium gas from flowing from the center to the periphery heat accumulators 16 and 18 or vice versa. The thermal insulation between the center and periphery heat accumulators 16 and 18 is adequately increased. Accordingly, effect of the above control is further enhanced.

Moreover, the center and periphery heat accumulators 16 and 18 are made of a number of blocks separated from one another in the circumferential and radial directions. Accordingly, the thermal expansion of the center and periphery heat accumulators 16 and 18 is compensated by the clearances between the blocks of the center and periphery heat accumulators 16 and 18. Therefore, the thermal strength and thermal durability are further improved.

Figure 3A:
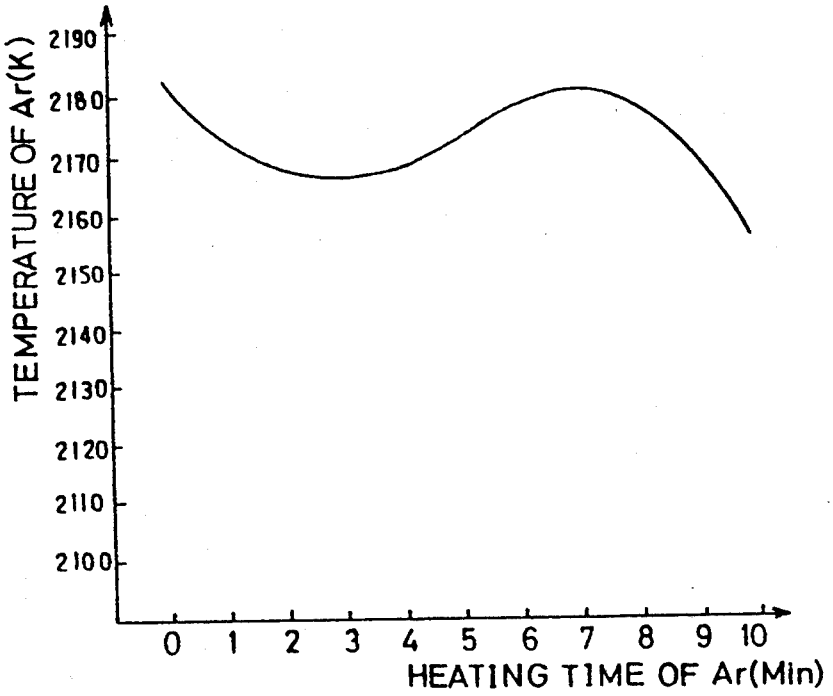
FIG. 3A is a graph showing a change in the temperature of medium gas on a time basis in the regenerative heat exchanger system.
Figure 3B:
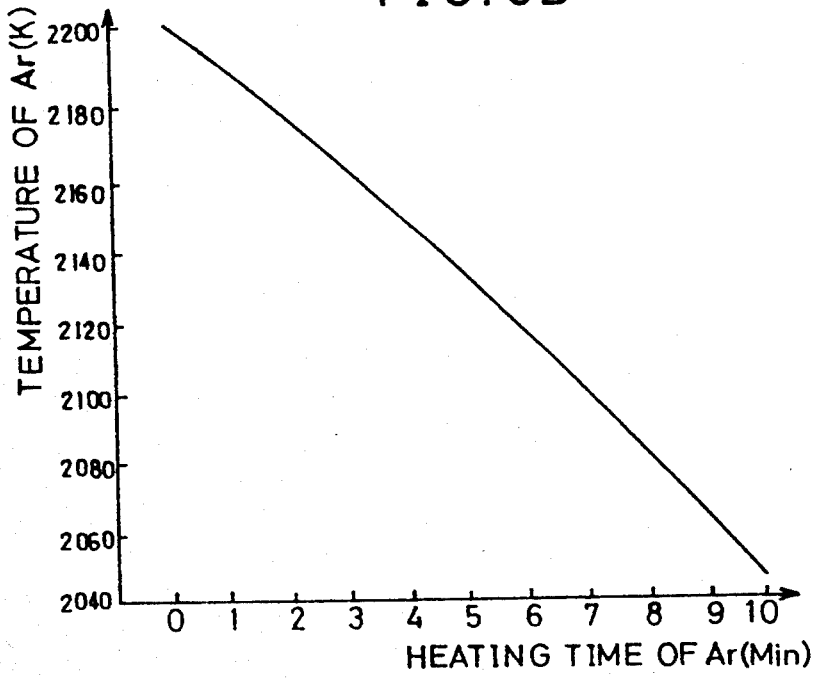
FIG. 3B is a graph showing a change in the temperature of medium gas on a time basis in a conventional regenerative heat exchanger system.

FIG. 3A is a graph showing a change in the temperature of medium gas of argon gas on a time basis in the regenerative heat exchanger system of the present invention. FIG. 3B is a graph showing a change in the temperature of medium gas of argon gas on a time basis in the conventional regenerative heat exchanger system shown in FIG. 9. As shown in FIG. 3B, the conventional regenerative heat exchanger system can generate medium gas having a very high temperature in the very beginning of the heat exchange operation. However, the gas temperature soon decreases linearly in proportion to the elapsing time, and becomes considerably lower at the end of the heat exchange operation. On the contrary, the regenerative heat exchanger system of the present invention can stabilize and maintain the temperature of the medium gas at a relatively high temperature level for a long time during the heat exchange operation.

Figure 5:
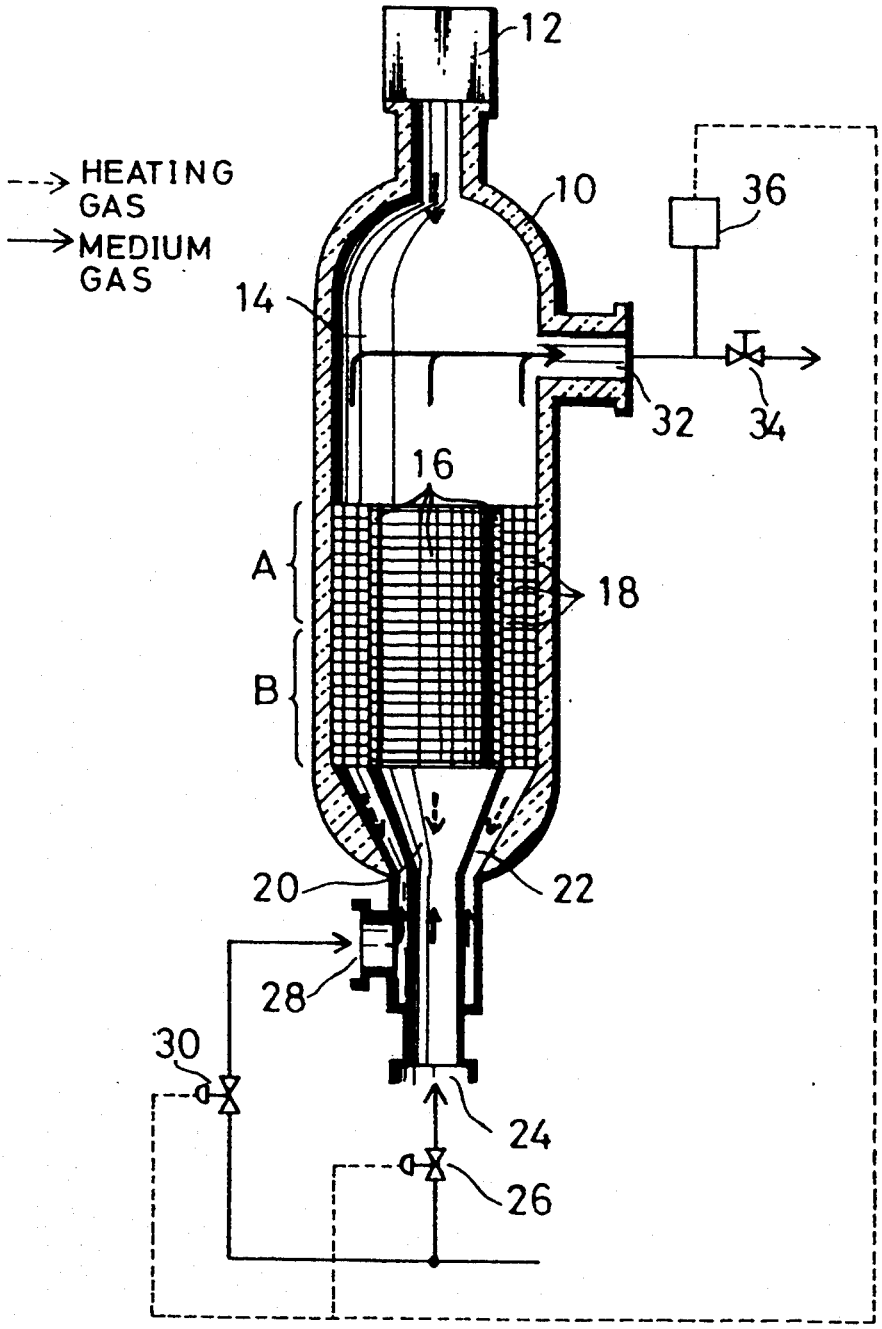
FIG. 5 is a schematic diagram showing a second regenerative heat exchanger system in accordance with the present invention.

Next, a second embodiment of the present invention will be described with reference to FIG. 5. The second embodiment has a flow controller 36 instead of the controller 35 of the first embodiment. The flow controller 36 detects the temperature of the medium gas flowing from the outlet 32, and a feedback-control method adjusts the flow through valves 26, 30 on the basis of the temperature of the medium gas flowing from the outlet 32. In other words, the amount of medium gas to be supplied to the first and second passages 20, 22 are respectively controlled by the flow-adjusting valves 26, 30 in such a manner that the temperature of the medium gas from the outlet 32 is maintained at a target constant value. Specifically, the amount of medium gas supplied through the flow-adjusting valve 26 to the center heat accumulator 16 is increased with decreasing gas temperature. Accordingly, this second embodiment can stabilize and maintain the temperature of medium gas at a relatively high temperature zone for a long time during the heat exchange operation in the same manner as the first embodiment.

The present invention is not limited to the above embodiments disclosed above. Further, the following modifications and embodiments will be appreciated in the present invention.

(1) The above embodiments employ an automatic system including the controller 35 or the flow controller 36. However, it may be possible to manually control the flow of medium gas to the center and periphery heat accumulators 16 and 18.

Figure 6A:
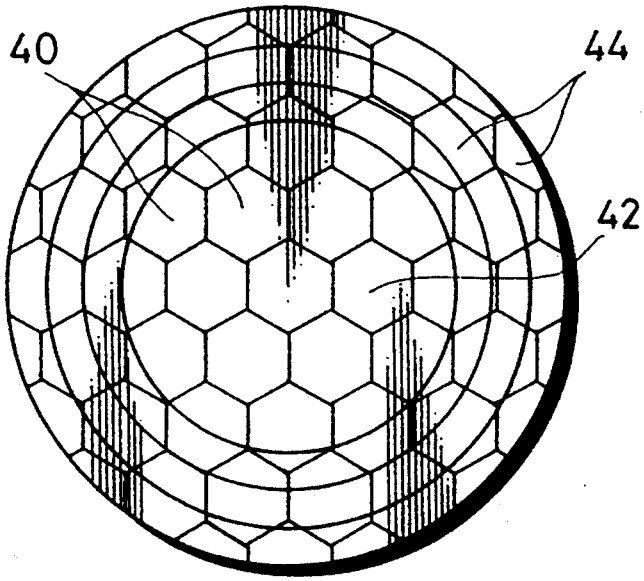
FIGS. 6A and 6B are plan views showing variations of the heat accumulator.
Figure 6B:
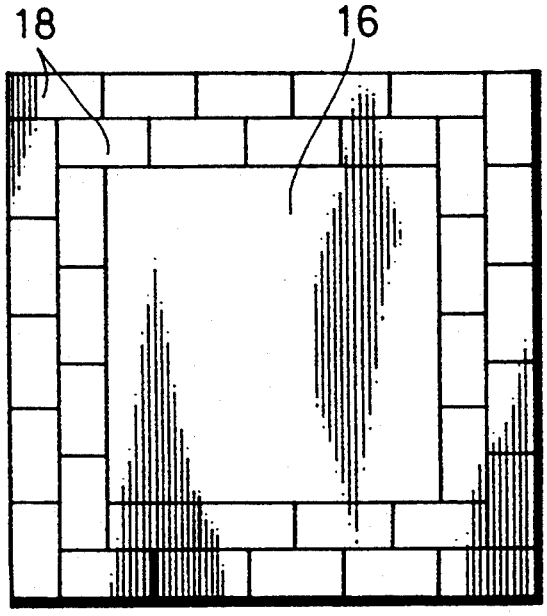

(2) The center and periphery heat accumulators 16 and 18 shown in FIG. 2 are made of a number of blocks separated from one another in both circumferential and radial directions. However, it may be possible that the center and periphery heat accumulators 16 and 18 are made of blocks separated from one another in either a circumferential or a radial direction in the case where thermal expansion is not severe. The heat accumulator is not limited to the ones disclosed in the above embodiments. For example, it may be possible to use a heat accumulator shown in FIG. 6A which is made of a number of hexagonal bricks 40 and has a center heat accumulator 42 and a periphery heat accumulator 44 which are separated in a radial direction. Furthermore, it may be possible to use a heat accumulator shown in FIG. 6B which is made of rectangular bricks and has a periphery heat accumulator 18 and a center heat accumulator 16.

(3) The above first and second embodiments shown the heat accumulator having a higher temperature region at a center thereof and a lower temperature region surrounding the center. However, it will be appreciated that the higher temperature region is not limited to a center only. For example, in the case of using an insulating vessel having a horizontal section in the form of a doughnut having a hollow region in the center thereof, it will be appreciated to define the lower temperature region on both an innermost portion adjacent to an inner periphery wall of the vessel and an outermost portion adjacent to an outer periphery wall of the vessel, and the higher temperature region on an intermediate portion between the innermost and outermost portions.

Figure 7:
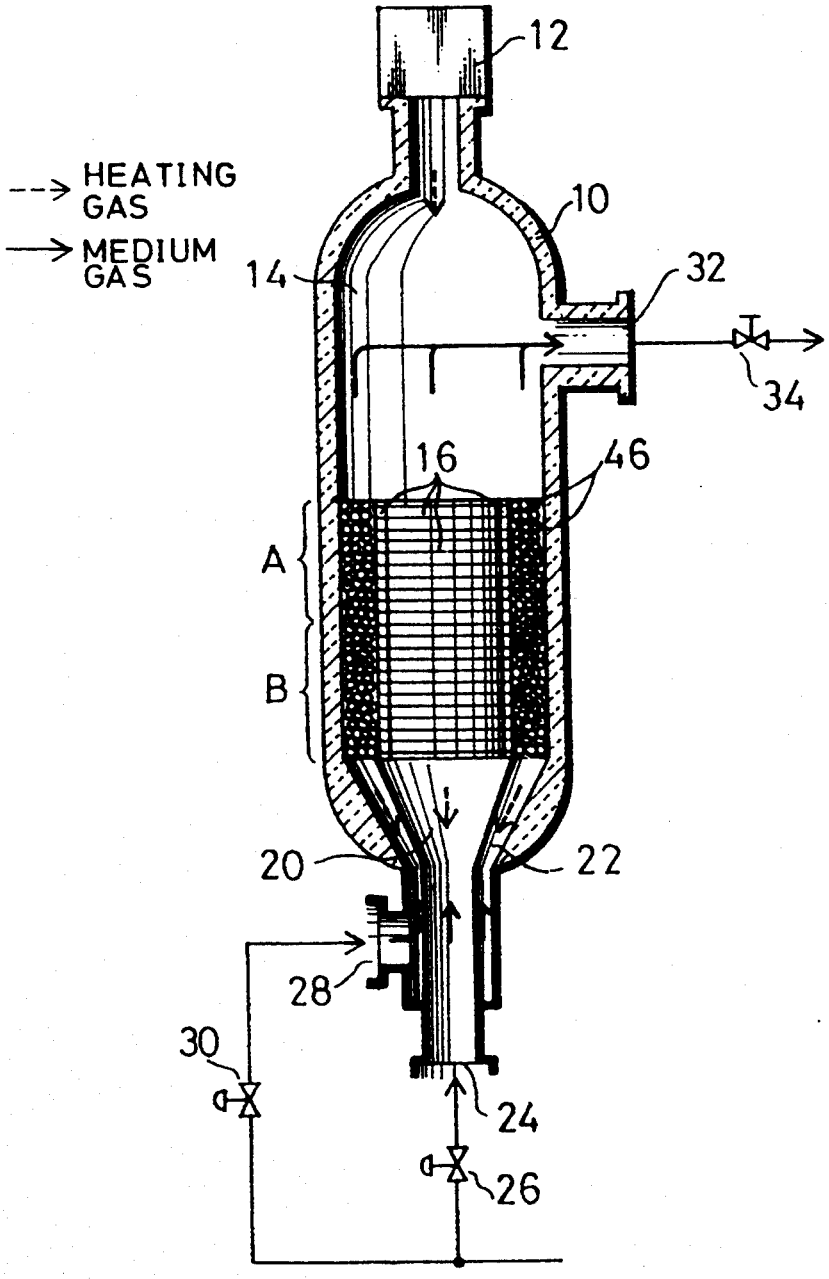
FIG. 7 is a schematic diagram showing a third regenerative heat exchanger system in accordance with the present invention.
Figure 8:
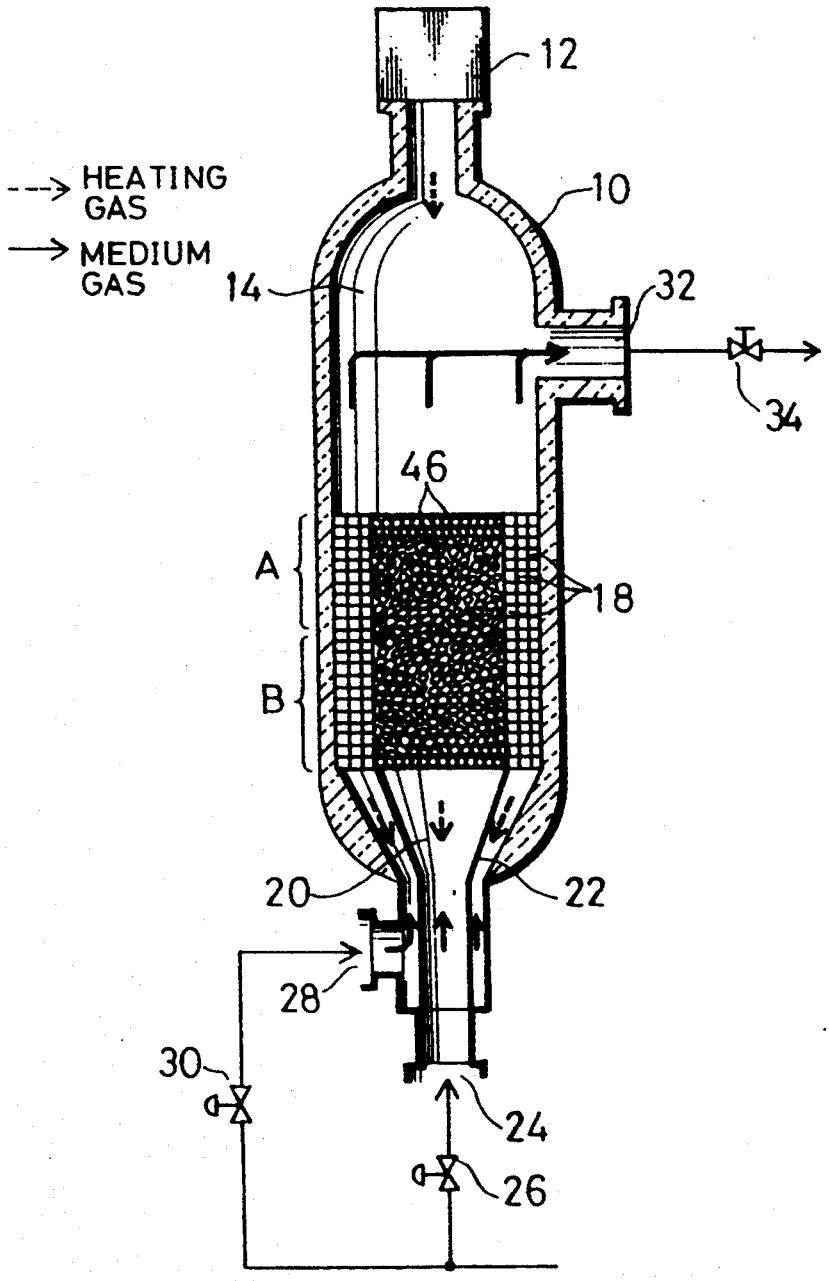
FIG. 8 is a schematic diagram showing a fourth regenerative heat exchanger system in accordance with the present invention.

(4) The center and periphery heat accumulators in the above first and second embodiments are both made of brick blocks having a gas passage. However, as shown in FIG. 7, it may be possible to use a heat accumulator including a periphery heat accumulator filled with a great number of pebbles 46. Also, as shown in FIG. 8, it may be possible to use a heat accumulator including a center heat accumulator filled with a great number of pebbles 46.

(5) The above embodiments divide the heat accumulator into two regions; i.e., the high temperature region and low temperature region. However, it is needless to say that the heat accumulator can be divided into three or more regions. In any case, the similar effect can be obtained by providing gas passages for supplying medium gas to respective regions independently.

(6) The above regenerative heat exchanger system can sufficiently provide a stabilized medium gas by a single heat exchanger. However, it will be appreciated that two or more heat exchangers may be used as shown in the above-mentioned Japanese Patent Publication No. 61-285394.

Figure 9:
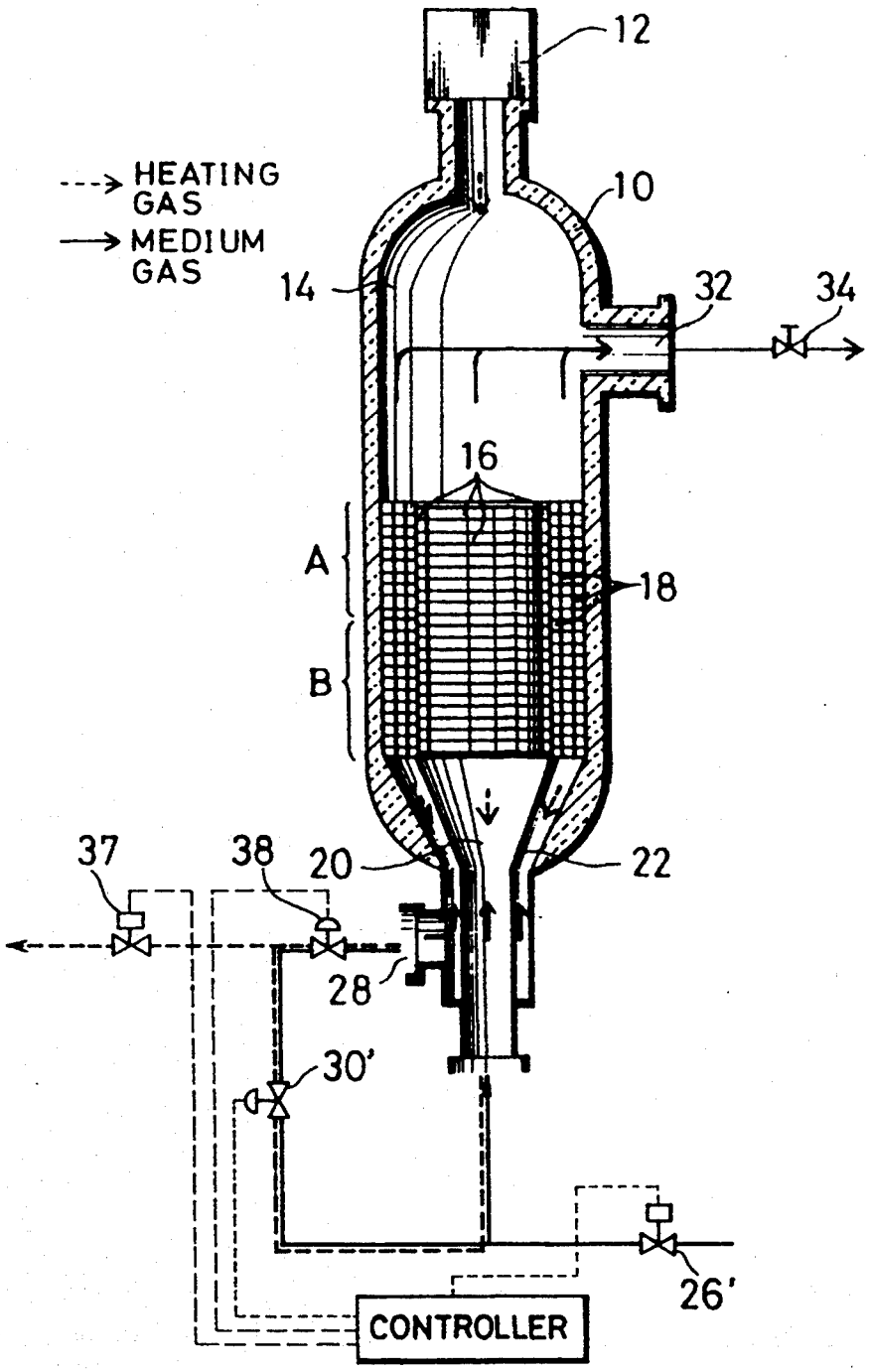
FIG. 9 is a schematic diagram showing a fifth regenerative heat exchanger system in accordance with the present invention.
Figure 10:
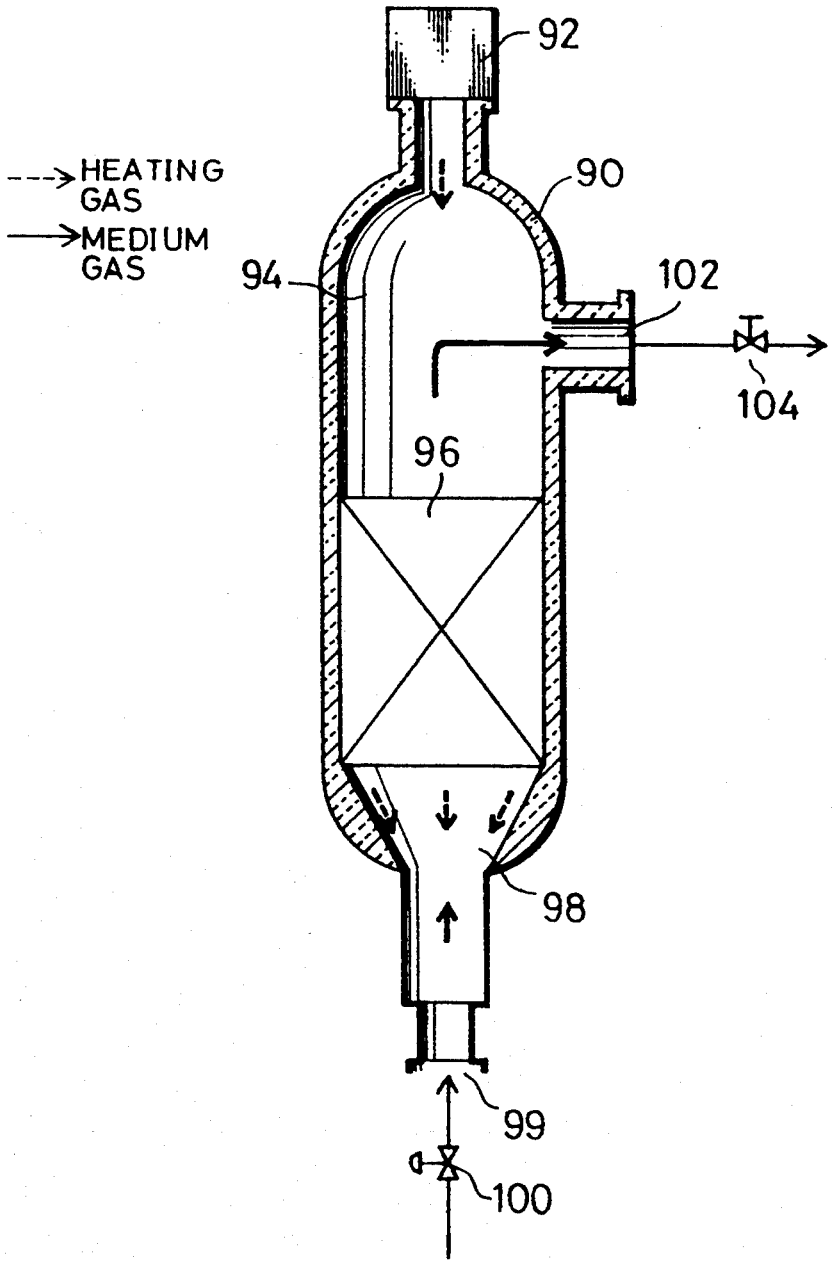
FIG. 10 PRIOR ART
FIG. 10 is a schematic diagram showing a conventional regenerative heat exchanger system.

(7) In the above embodiments, the high temperature region is formed on the center portion and the low temperature region is formed on the periphery portion by merely flowing downward the heating gas from the burner provided on the top of the insulating vessel. In accordance with the present invention, however, it may be possible to form the high temperature region on a periphery portion of the heat accumulator and the low temperature region on a center portion by a system shown in FIG. 9. The regenerative heat exchanger system of FIG. 9 is provided with a medium gas-supply line and a heating gas discharge line on the bottom portion of an insulating vessel 10. The medium gas-supply line has a total flow-adjusting valve 26' for adjusting the total flow of medium gas into the vessel 10, and a branch flow-adjusting valve 30' for adjusting the flow ratio between the flow of medium gas into a passage 20 and the flow of medium gas into a passage 22. The heating gas discharge line has a total flow-adjusting valve 37 for adjusting the total discharge of heating gas from the vessel 10, and a branch discharge adjusting valve 38 for adjusting the discharge ratio between the discharge of heating gas from the passage 20 and the discharge of heating gas from the passage 22. These adjusting valves 26', 30', 37 and 38 are controlled by a controller 35. The medium gas-adjusting valves 26' and 30' are controlled in the same manner as the system of FIG. 1. On the other, the heating gas-adjusting valves 37 and 38 are controlled in such a manner that the heating gas is discharged from the passage 22 greater than from the passage 20. Such heating gas discharge heats the periphery heat accumulator 18 to a higher temperature than the center heat accumulator 16. Consequently, the high temperature region is formed on the periphery portion and the low temperature region is formed on the center portion.

(8) In the above embodiments, the high temperature region and the low temperature region are arranged in coaxial form. However, it may be appreciated that the high and low temperature regions are juxtaposed in a horizontal direction; for example, an arrangement of a high temperature region on a right half portion of the heat accumulator and a low temperature region on its left half portion.

As mentioned above, the heat accumulator is defined with the high and low temperature regions on the basis of temperature distribution after the heating gas is flowed through the heat accumulator. The medium gas is flowed through the respective temperature regions independently. Further, the flow of medium gas to the high temperature region is increased with elapsing time. Also, a temperature of a mixture of heated medium gases from the high and low temperature regions is detected and the flow of medium gas to the high and low temperature regions is controlled so as to keep the mixture at a predetermined temperature. Accordingly, the temperature of heated medium gas can be stabilized or maintained at a desired high temperature for a longer time without increasing the number of regenerative heat exchangers.

Also, the use of flow-adjusting valves, temperature detector, and flow controller makes it possible to automatically stabilize the temperature of medium gas. Specifically, the high temperature region is defined on the center portion while the low temperature region is defined on the periphery in contact with the inner wall of the vessel. This can assure efficient utilization of the heat energy stored in the heat accumulator.

Further, one layer of the heat accumulator is made of blocks separated from one another in a radial or circumferential direction. Accordingly, the heat accumulator can be provided with an increased thermal strength and durability because clearances between blocks can offset the thermal expansion of the heat accumulator.

Further, the block layers of the high temperature region and those of the low temperature region are shifted from one another in the gas flowing direction, which thus prevents thermal energy from flowing from the higher temperature region to the lower temperature region, and increases the thermal separability between the high and low temperature regions.

As this invention may be embodied in several forms without departing from the spirit of essential characteristics thereof, the present embodiments are therefore illustrative and not restrictive, since the scope of the invention is defined by the appending claims rather than by the description preceding them, and all changes that fall within meets and bounds of the claims, or equivalence of such meets and bounds are, therefore, intended to be embraced by the claims.

What is claimed is:

1. A regenerative heat exchanger system comprising:

a vessel formed by an insulating wall;

a heat accumulator provided in the insulating vessel for accumulating heat energy, the heat accumulator having a first end and a second end opposing to the first end and being capable of permitting gas to flow through a body between the first and second ends;

heating means for heating the heat accumulator by flowing heating gas from the first end to the second end in such a manner that the heat accumulator is formed with a plurality of temperature-different regions in a direction normal of the gas flowing direction;

medium gas-supplying means for flowing medium gas through the plurality of temperature-different regions independently from one another from the second end to the first end after the heat accumulator being heated;

mixing means provided adjacent to the first end for mixing heated medium gas having passed one temperature region with heated medium gas having passed another temperature region.

2. A regenerative heat exchanger system in accordance with claim 1, wherein the plurality of temperature-different regions include a high temperature region and a low temperature region.

3. A regenerative heat exchanger system in accordance with claim 2, wherein the high temperature region is defined on an inner portion of the heat accumulator and the low temperature region is defined on an outer portion of the heat accumulator.

4. A regenerative heat exchanger system in accordance with claim 2, wherein the high temperature region and the low temperature region are made of a plurality of blocks being piled in the gas flowing direction, each block having a gas passage extending in the gas flowing direction.

5. A regenerative heat exchanger system in accordance with claim 4, wherein one layer of the piled blocks of the high temperature region is made of blocks separated from one another in either a circumferential direction or a radial direction.

6. A regenerative heat exchanger system in accordance with claim 4, wherein one layer of the piled blocks of the low temperature region is made of blocks separated from one another in either a circumferential direction or a radial direction.

7. A regenerative heat exchanger system in accordance with claim 4, wherein the block layers of the high temperature region and the block layers of the low temperature region are shifted from each other in the gas flowing direction.

8. A regenerative heat exchanger system in accordance with claim 2, wherein one of the high temperature region and the low temperature region is made of a plurality of blocks being piled in the gas flowing direction, each block having a gas passage extending in the gas flowing direction, and the other temperature region is made of a number of small solids having shapes different from one another.

9. A regenerative heat exchanger system in accordance with claim 1, wherein the medium gas-supplying means includes:

flow-adjusting means for adjusting the flow of medium gas to the high temperature region and the low temperature region; and control means for controlling the flow-adjusting means to increase the flow of medium gas to the high temperature region with elapsing time after initiating the supplying of the medium gas to the heat accumulator.

10. A regenerative heat exchanger system in accordance with claim 1, wherein the medium gas-supplying means includes:

temperature-detecting means for detecting a temperature of heated medium gas mixed by the mixing means;

flow-adjusting means for adjusting the flow of medium gas to the high temperature region and the low temperature region; and control means responsive to the temperature-detecting means for controlling the flow-adjusting means to adjust the respective flows of medium gas to the high and low temperature regions to keep the heated medium gas at a predetermined temperature.

11. A method for operating a regenerative heat exchanger system including a heat accumulator capable of providing a plurality of temperature-different regions, the method comprising the steps of:

flowing medium gas through the plurality of temperature-different regions independently from one another; and increasing the flow of medium gas to a higher temperature region of the plurality of temperature-different regions with elapsing time after initiating the supplying of the medium gas to the heat accumulator.

12. A method for operating a regenerative heat exchanger system including a heat accumulator capable of providing a plurality of temperature-different regions, the method comprising the steps of:

flowing medium gas through the plurality of temperature-different regions independently from one another;

detecting a temperature of a mixture of heated medium gases from the plurality of temperature-different regions of the heat accumulator; and controlling the flow of medium gas to the plurality of temperature-different regions to keep the mixture at a predetermined temperature.

* * * * *